United States Patent [19]

Gorodissky et al.

[11] Patent Number: 4,941,866

[45] Date of Patent: Jul. 17, 1990

[54] CENTRIFUGE

[76] Inventors: Boris P. Gorodissky, Leninsky prospekt, 154, kv. 201; Jury A. Lotts, ulitsa Chusovskaya, 11, korpus 6, kv. 91; Lev N. Veretenov, B.Tolmachevsky pereulok, 4, kv. 10, all of, Moscow, U.S.S.R.

[21] Appl. No.: 241,983

[22] PCT Filed: Nov. 20, 1986

[86] PCT No.: PCT/SU86/00120

§ 371 Date: Jun. 29, 1988

§ 102(e) Date: Jun. 29, 1988

[87] PCT Pub. No.: WO88/03840

PCT Pub. Date: Jun. 2, 1988

[51] Int. Cl.[5] ..... B04B 15/02

[52] U.S. Cl. ..... 494/14; 494/83; 494/15

[58] Field of Search ..... 417/368, 372, 413, 902; 494/14, 83, 13, 15, 60

[56] References Cited

U.S. PATENT DOCUMENTS

| | | | |
|---|---|---|---|
| 3,327,938 | 6/1967 | Stallman | 494/15 |
| 3,602,425 | 8/1971 | Schmidt | 494/15 X |
| 3,942,716 | 3/1976 | Jacobson et al. | 494/15 |
| 4,316,434 | 2/1982 | Bailey | 122/20 B |
| 4,376,902 | 3/1983 | Soussa | 310/54 |
| 4,470,772 | 9/1984 | Gannaway | 417/368 |

*Primary Examiner*—Frankie L. Stinson

*Attorney, Agent, or Firm*—Burgess, Ryan & Wayne

[57] ABSTRACT

A centrifuge comprises a vacuum chamber (1) accomodating a replaceable rotor (7). The vacuum chamber (1) includes an evaporator (4) connected to a cooling unit (3). A drive (9) of the rotor (7) is journalled in bearings (10), and has a cooling jacket (21). An oil tank (12) with a pump (11) are provided to feed the oil to the bearings (10). The centrifuge also has a heat exchanger (19) for cooling the oil arranged so as to ensure heat transfer between the oil and cooling agent of the cooling unit (3). The pump (11) is connected through the heat exchanger (19) and cooling jacket (21) to the oil tank (12).

2 Claims, 2 Drawing Sheets

CENTRIFUGE

FIELD OF THE INVENTION

This invention relates to centrifuges used in biology, biophysics, medicine and other fields of science and technology.

A major requirement imposed on centrifuges is maintenance of the required temperature conditions of a replaceable rotor, its drive, and diffusion pump (if provision of such a pump is envisaged).

BACKGROUND OF THE INVENTION

There is known a centrifuge (cf., a pamphlet of the Beckman Company "Preparation Ultracentrifuge", L 8, p. 5) comprising a vacuum chamber, a drive of a replaceable rotor, a diffusion pump, a refrigeration system, and a system for cooling the drive and diffusion pump. In this centrifuge, the temperature conditions of the drive of the replaceable rotor are maintained by an additional cooling unit built into the centrifuge. Such an arrangement structurally over-complicates the centrifuge, since it requires the provision of two cooling units, viz., one in the refrigeration system of the vacuum chamber, and one in the cooling system of the drive.

There is also known a centrifuge (cf., materials of the Symposium "Laboratory Centrifuge and Ultracentrifuges of the 'Heraeus Christ' Company", pp. 4 to 6) comprising a vacuum chamber, a drive of a replaceable rotor, a diffusion pump, a refrigeration system, a system for lubricating the drive bearings, and a cooling system. In this centrifuge, the temperature conditions of the replaceable rotor are maintained by the refrigeration system, whereas the temperature conditions of the drive of the replaceable rotor and diffusion pump—by a cooling system in which water from a water main line is used as a cooling agent. This, in turn, makes the system less mobile, necessitates additional pipes for feeding and discharging water, filters and special fixtures. Another disadvantage is associated with periodic cleaning of the pipes, filters and passages. In addition, water discharged from the centrifuge is not fit for reuse, which is very disadvantageous both from the economic and ecological points of view.

There is also known a modification of the aforedescribed construction (cf., materials of aforesaid Symposium, p. 15) comprising a vacuum chamber accommodating a replaceable rotor, a cooling unit connected via a line circulating a cooling agent to an evaporator disposed inside said chamber, a drive of the replaceable rotor having bearings and a cooling jacket, and an oil tank with a pump for feeding oil to the bearings. Cooling of the rotor drive and diffusion pump is done in this centrifuge construction by a special electrical means for circulating water.

This arrangement is rather complicated, since it necessitates an additional water tank, a pump for circulating the water, a heat exchanger and a second cooling unit. An accompanying disadvantage is excessive weight and size of the centrifuge.

SUMMARY OF THE INVENTION

It is an object of the invention to provide a centrifuge having such a construction as to enable the use of the bearing lubricating oil as a medium for cooling the rotor drive to thereby structurally simplify the centrifuge and reduce its size and weight.

The aims of the invention are attained by that in a centrifuge comprising a vacuum chamber accommodating a replaceable rotor, a cooling unit connected by way of a line circulating the cooling agent to an evaporator disposed in the vacuum chamber, a rotor drive having bearings and a cooling jacket, and an oil tank having a pump for feeding oil to the bearings, according to the invention, it is provided with a heat exchanger for cooling the oil arranged so as to ensure heat exchange between the oil and cooling agent of the cooling unit, whereas the pump for feeding the oil to the bearings is connected through the heat exchanger and cooling jacket of the drive of the rotor to the oil tank.

This arrangement of the cooling system of the rotor drive allows to use the bearing lubricating oil as a medium for cooling the rotor drive, whereby it becomes possible to dispense with additional means for cooling the rotor drive, and provide a small-size structurally simple centrifuge.

Preferably, the proposed centrifuge is provided with a diffusion pump having a cooling jacket, the pump for feeding oil to the bearings of the drive of the rotor being connected through the heat exchanger, cooling jacket of the diffusion pump and cooling jacket of the rotor drive to the oil tank.

Such a construction enables to cool the diffusion pump without the use of an additional cooling agent and extra special means to simplify the centrifuge and reduce its weight.

BRIEF DESCRIPTION OF THE DRAWINGS

The invention will now be described in greater detail with reference to various specific embodiments thereof taken in conjunction with the accompanying drawings, in which.

BEST MODE OF CARRYING OUT THE INVENTION

Industrial centrifuge operating at high rotation speeds and also known as ultracentrifuges are normally provided with a vacuum system for maintaining the desired degree of underpressure, a refrigeration system for maintaining the desired temperature conditions, a lubrication system, and a system for cooling the rotating parts, particularly bearings.

Figure 1:
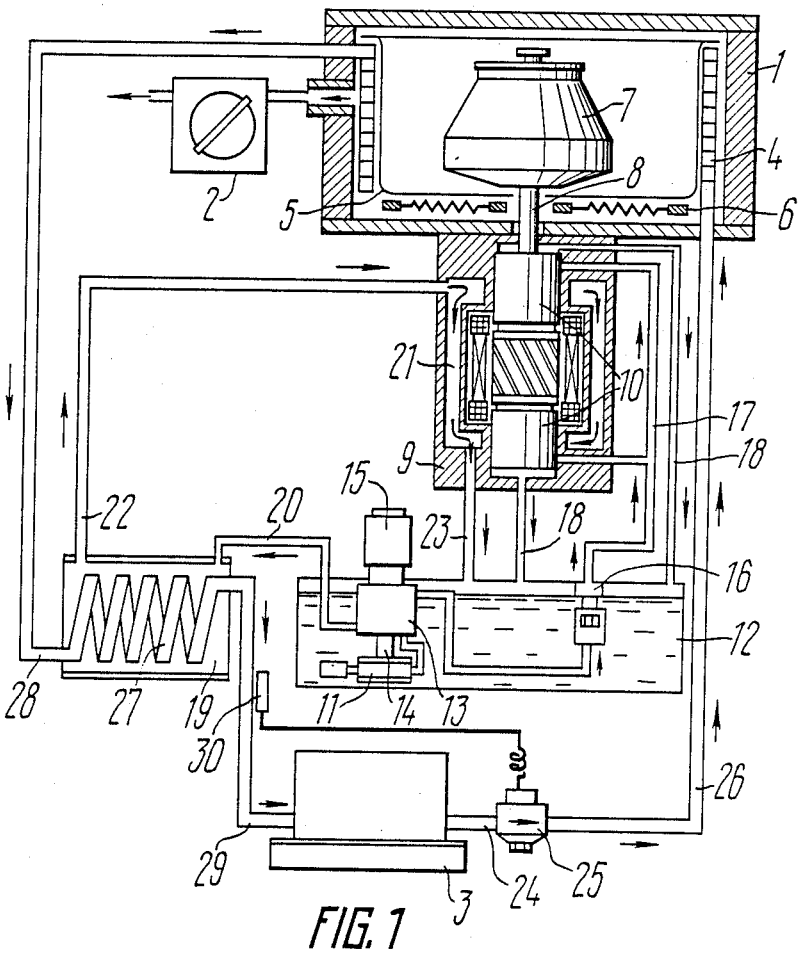
FIG. 1 is a general schematic representation of a centrifuge, according to the invention, having vacuum and refrigeration system, a lubricating system, and a cooling system.

Referring now to FIG. 1 showing schematically a specific non-inclusive modifications of the proposed centrifuge, the vacuum system for maintaining the desired degree of underpressure in a vacuum chamber 1 (FIG. 1) comprises a vacuum pump 2. The vacuum chamber 1 accommodates means ensuring the required conditions of centrifuging.

The refrigeration system includes a cooling unit 3, and an evaporator 4 accommodated in the chamber 1. A heater 6 is arranged between the bottom of the chamber 1 and shell 5 of the evaporator 4.

Mounted inside the chamber 1 is a replaceable rotor 7 secured on a flexible shaft 8 of the drive 9.

The preset temperature conditions of the replaceable rotor 7 are maintained by the cooling unit 3 and heater 6. For facilitating lubrication of bearings 10 of the drive 9 which rotates the replaceable motor 7 there is provided a lubrication system including an oil pump 11 secured in an oil tank 12. The oil tank 12 accommodates a filter 13 mounted on a post 14 connecting the pump 11 to an electric motor 15. A valve 16 connected by way of a pipe 17 to the bearings 10 is used for feeding oil from the oil tank 12 to the bearings 10. The pipe 18 is connected to the drive 9 and to the tank 12, and serves to evacuate the oil from the bearings 10.

The cooling system for maintaining preset temperature conditions of the drive 9 comprises a heat exchanger 19 and pipes communicating it with the refrigeration system and lubrication system. The valve 16 and pipes 17, 18 define a lubrication circuit for lubricating the bearings of the drive 9. The filter 13 communicates by pipe 20 with the heat exchanger 19. A cooling jacket 21 of the drive 9 also communicates by a pipe 22 with the heat exchanger 19. Oil circulating through the heat exchanger 19 is returned to the oil tank through a pipe 23.

The heat exchanger 19, pipes 20, 22, 23 and cooling jacket 21 form a cooling circuit of the drive 9. The cooling unit 3 communicates by pipe 24 with a temperature-control valve 25 which is connected by a pipe 26 to the evaporator 4. The evaporator 4 is connected to a coil 27 of the heat exchanger 19 by a pipe 28. The coil 27 is in turn, connected by a pipe 29 to the cooling unit 3. The pipes 26, 28 and 29 form a line for circulating a cooling agent of the cooling unit 3. The heat exchanger 19 is arranged so as to ensure heat transfer between the cooling agent and oil circulating in the heat exchanger. Provided on the pipe 29 is a thermosensitive element 30 which controls the temperature-control valve 25. In this manner the cooling agent of the cooling unit 3 circulating in the cooling circuit of the replaceable rotor 7 simultaneously cools the oil circulating in the cooling circuit of the drive 9.

The centrifuge operates in the following manner. A preparation to be analyzed is charged to the replaceable rotor 7, after which the rotor is mounted on the flexible shaft 8 of the drive 9. The vacuum pump 2 is then engaged, and the pump 11 and cooling unit are actuated. Upon attaining a preset residual pressure in the chamber 1, the drive 9 is energized to accelerate the rotor 7 to a preset rotational speed. Described successively hereinafter will be operation of the lubrication, refrigeration and cooling systems.

The lubrication system operates as follows. Oil is conveyed by the pump 11 from the tank 12 to the filter 13 and then to the valve 16 to flow therefrom along the pipe 17 to the bearings 10. From the bearings 10 the oil flows along the pipe 18 to the tank 12.

The refrigeration system operates in the following manner. Liquid freon used as a cooling agent is conveyed from the cooling unit 3 along the pipe 24 to the temperature-control valve 25 from which it is fed along the pipe 26 to the evaporator 5. The freon is then conveyed along the pipe 28 to the coil 27 of the heat exchanger 19, wherefrom it flows along the pipe 29 to the cooling unit 3. Maintaining a preset temperature of oil fed to the cooling circuit of the drive 9 is necessary in order to optimize operating conditions of the drive 9 irrespective of the temperature of the outside medium. The oil temperature is controlled by the temperature-control valve 25. A control signal is conveyed to the valve 25 from the thermosensitive element 30 arranged on the pipe 29. Oil circulating in the cooling circuit is fed to this circuit by the same pump 11 which is used in the lubrication system. Operation of the pump 11 causes the oil to flow from the filter 13 through the pipe 20 to the heat exchanger 19 where it is cooled.

The cooled oil is conveyed along the pipe 22 to the cooling jacket 21, wherefrom it flows along the pipe 23 to be returned to the oil tank 12.

Figure 2:
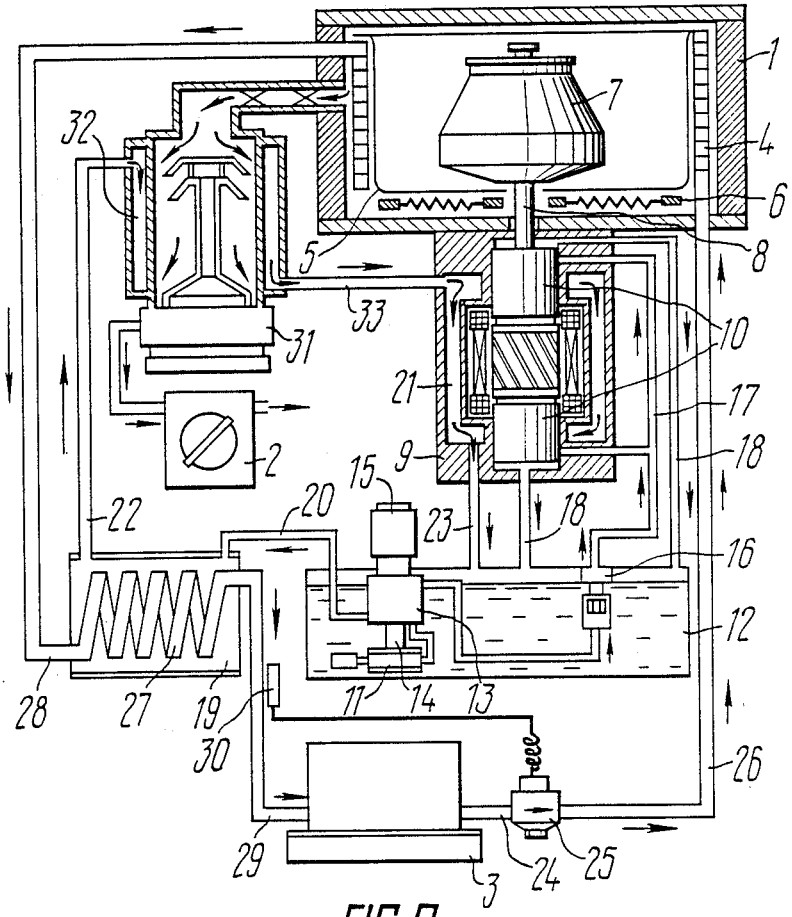
FIG. 2 shows an embodiment of the proposed centrifuge having a diffusion pump.

With reference to FIG. 2, there is shown a modified form of the proposed centrifuge having a diffusion pump 31 with a cooling jacket 32 connected by a pipe 33 to the cooling jacket 21 of the drive 9.

This centrifuge operates in a similar manner, except that oil flows from the heat exchanger 19 along the pipe 22 to the cooling jacket 32 of the diffusion pump 31 and further along the pipe 33 to the cooling jacket 21 of the drive 9, wherefrom it is returned to the oil tank 12 along the pipe 23. The temperature of oil circulating in the cooling system is maintained by the cooling unit of the refrigeration system. This obviates the need for a second cooling unit and second tank with a pump for circulating the cooling agent. Another advantage is that the space occupied by the cooling system amounts to not more than 1.5% of the entire volume of the centrifuge.

INDUSTRIAL APPLICABILITY

The invention allows to maintain the preset temperature conditions of the drive of the replaceable rotor of the centrufuge and diffusion pump (if the construction of the centrifuge envisages such a pump). Thanks to such a construction of the cooling system enabling to use oil for lubricating bearings of the rotor drive as an agent for cooling this drive, there is no need for providing a second cooling unit, or a second tank with a pump for circulating the cooling agent and a cooling radiator. In general, the proposed centrifuge is small-size and simple to fabricate.

We claim:

1. A centrifuge which comprises a replaceable rotor arranged to rotate in a rotor drive coupled vacuum chamber; a means for providing a vacuum to the vacuum chamber, to the rotor, the rotor drive having oil lubricating bearings and a cooling jacket to control a temperature of the rotor drive; an oil reservoir for the lubricating oil; a lubricating oil pump in liquid flow communication with the oil in the reservoir, and in liquid flow communication with the bearings to direct the oil from bearing oil outlet to the oil reservoir; an oil cooling heat exchange means in liquid oil flow communication with the oil pump; the oil cooling heat exchange means being in liquid oil flow communication with the cooling jacket of the rotor drive; a means in liquid oil flow communication with the cooling jacket of the rotor drive to direct the oil from the cooling jacket to the oil reservoir;

a cooling means in cooling medium fluid flow communication with a vacuum chamber cooling unit, to provide cooling for the vacuum chamber a cooling medium outlet of the vacuum chamber cooling unit being in cooling medium flow communication with the oil cooling heat exchange; an outlet of the oil cooling heat exchange being in cooling medium flow communication with the cooling means.

2. A centrifuge of claim 1 having a diffusion pump with a cooling jacket to provide a vacuum to the vacuum chamber wherein the outlet of the oil cooling heat exchange means is in fluid communication with an inlet of the diffusion pump cooling jacket and an outlet of the diffusion pump cooling jacket is in fluid communication with an inlet of the rotor drive cooling jacket.

* * * * *